US007516931B2

(12) United States Patent
Sarullo

(10) Patent No.: US 7,516,931 B2
(45) Date of Patent: Apr. 14, 2009

(54) BEVERAGE CONTAINER HOLDER

(75) Inventor: Phillip Sarullo, Madison, MS (US)

(73) Assignee: S.G. Enterprises, Inc., Madison, MS (US)

( * ) Notice: Subject to any disclaimer, the term of this patent is extended or adjusted under 35 U.S.C. 154(b) by 107 days.

(21) Appl. No.: 11/551,353

(22) Filed: Oct. 20, 2006

(65) Prior Publication Data

US 2007/0138365 A1 Jun. 21, 2007

Related U.S. Application Data

(60) Provisional application No. 60/751,954, filed on Dec. 20, 2005, provisional application No. 60/780,086, filed on Mar. 8, 2006, provisional application No. 60/780,085, filed on Mar. 8, 2006.

(51) Int. Cl.
*A47K 1/08* (2006.01)

(52) U.S. Cl. ..... 248/311.2; 248/156; 248/311.3

(58) Field of Classification Search ..... 248/156, 248/311.2, 532, 907
See application file for complete search history.

(56) References Cited

U.S. PATENT DOCUMENTS

| | | | | | |
|---|---|---|---|---|---|
| 716,560 | A * | 12/1902 | Leininger | 248/156 |
| 1,173,036 | A * | 2/1916 | Robidoux | 248/132 |
| 1,326,086 | A * | 12/1919 | Ormandy | 248/311.2 |
| 1,448,808 | A * | 3/1923 | McGowan | 47/41.01 |
| 1,812,737 | A * | 6/1931 | Coughlin et al. | 47/41.01 |
| 1,874,185 | A * | 8/1932 | Goldstein | 47/41.01 |
| 2,482,278 | A * | 9/1949 | Koerner | 248/156 |
| 2,877,828 | A * | 3/1959 | Barnette, Jr. | 248/533 |
| 3,259,346 | A * | 7/1966 | Rogers | 248/518 |
| 3,360,224 | A * | 12/1967 | Baumann, Jr. | 248/530 |
| 3,788,583 | A * | 1/1974 | Byrd | 248/146 |
| 4,096,951 | A * | 6/1978 | Menssen | 211/207 |
| 4,319,726 | A * | 3/1982 | Andersson | 248/97 |
| 4,334,661 | A * | 6/1982 | Pitt | 248/146 |
| 4,928,876 | A * | 5/1990 | Marshall | 229/103.1 |
| 5,118,063 | A * | 6/1992 | Young, Sr. | 248/311.2 |
| 5,479,880 | A * | 1/1996 | Stuhr et al. | 119/57.8 |
| 5,570,952 | A * | 11/1996 | Protz, Jr. | 362/431 |
| 5,667,174 | A * | 9/1997 | Adams | 248/156 |
| 5,713,546 | A * | 2/1998 | Auspos | 248/156 |
| 5,823,496 | A * | 10/1998 | Foley et al. | 248/314 |
| 5,836,105 | A * | 11/1998 | Loosen | 47/39 |
| 5,881,495 | A * | 3/1999 | Clark | 47/48.5 |
| 6,149,119 | A * | 11/2000 | O'Connell | 248/545 |
| 6,318,017 | B1 * | 11/2001 | Genardo | 43/21.2 |
| 6,371,139 | B1 * | 4/2002 | Simchori | 135/20.1 |
| 6,425,555 | B1 * | 7/2002 | Hedeman | 248/27.8 |
| 6,575,417 | B1 * | 6/2003 | Krommenakker | 248/311.2 |
| 6,675,819 | B2 * | 1/2004 | Arrowood et al. | 135/16 |
| 6,732,985 | B1 * | 5/2004 | Cantrell | 248/125.1 |
| 6,820,379 | B1 * | 11/2004 | Krinner et al. | 52/157 |
| 6,945,502 | B2 * | 9/2005 | Restifo | 248/146 |
| 7,264,210 | B2 * | 9/2007 | Yu | 248/156 |

* cited by examiner

*Primary Examiner*—J. Allen Shriver, II
*Assistant Examiner*—Michael McDuffie
(74) *Attorney, Agent, or Firm*—Thomas, Kayden, Horstemeyer & Risley, LLP; Todd Deveau

(57) ABSTRACT

An beverage container holder includes a retaining member configured to retain a beverage container in an upright position, and an stabilizing member configured to support the retaining member off of a surface, such that the beverage container does not contact debris on the surface and is less likely to tip over.

10 Claims, 3 Drawing Sheets

BEVERAGE CONTAINER HOLDER

CROSS-REFERENCE TO RELATED APPLICATIONS

This application claims priority to U.S. provisional application entitled "PicNic Stick Beverage Holder," having Ser. No. 60/751,954, filed Dec. 20, 2005, which is entirely incorporated herein by reference.

This application claims priority to U.S. provisional application entitled "The PicNic Stick II," having Ser. No. 60/780,086, filed Mar. 8, 2006, which is entirely incorporated herein by reference.

This application claims priority to U.S. provisional application entitled "The PicNic Stick III," having Ser. No. 60/780,085, filed Mar. 8, 2006, which is entirely incorporated herein by reference.

FIELD OF THE INVENTION

The present disclosure generally relates to beverage container holders, and more particularly, to beverage container holders that retain and stabilize beverage containers in an upright position.

BACKGROUND

A beverage is usually consumed from a beverage container. The beverage container may be a glass or a cup into which the beverage is poured, or the beverage container may be the packaging in which the beverage is sold. For example, soft drinks and alcoholic beverages are often packaged in cans or bottles, which function as single-serving, disposable beverage containers. Similarly, children's beverages are often consumed directly from the boxes or pouches in which they are packaged.

Often, beverage containers are predisposed to tipping due to the dimension of the height of the container in comparison to the dimension of its base. For example, the height of a soft drink can is often more than twice the diameter of its base, and the height of a beer bottle is often more than three times the diameter its base. Tipping can be undesirable, in that it wastes the beverage and creates a mess requiring cleaning.

Beverages are often consumed outdoors, in which case the beverage container may be placed directly on the ground when the beverage is not being consumed. For example, at a beach the beverage container may be placed on the sand, and at a park the beverage container may be placed on the dirt or in the grass. In such cases, not only is the beverage container subject to tipping over, but the bottom of the beverage container may become coated in sand or dirt, which may be undesirable. From the above, it is apparent that a need exists for a beverage container holder that helps stabilize the beverage container, reducing its likelihood of tipping over, while also reducing its contact with debris.

SUMMARY

The beverage container holder of the present disclosure is directed to the problems mentioned above. In an exemplary embodiment, the present beverage container holder includes a retaining member configured to retain a beverage container in an upright position, and a stabilizing member designed for insertion into a ground surface and for reducing the likelihood that the retaining member may tip over. The retaining member and the stabilizing member can be connected together to form a unitary holder, or alternatively separate components designed to be releasably connected together.

In another exemplary embodiment, the beverage container holder includes a retaining member configured to retain a beverage container in an upright position, the retaining member forming a cavity having an opening at a top of the holder that is configured to receive the beverage container, and a stabilizing member configured for insertion into a ground surface, the stabilizing member having a surface penetrating member such as one or more pointed distal tips at a bottom of the holder configured to penetrate the ground surface. In an alternate embodiment, the retaining member can be formed as a hollow right cylinder, the hollow forming the cavity for receiving a beverage container. In another embodiment the retaining member is hollow and has walls that are tapered such that a width of the holder continuously either decreases or increases along a height of the retaining member, allowing for the retaining member of one beverage container holder to be nested within the retaining member of another beverage container. The walls of the retaining member may or may not be insulated.

In yet a further exemplary embodiment, the beverage container holder includes a circular plate, a sleeve coupled to an upper side of the circular plate, the sleeve having an opening and defining a cavity for receiving a beverage container, and one or more stakes coupled to a lower side of the circular plate, the stakes having a pointed distal tip at a distal point from the base.

Other systems, devices, features, and advantages of the disclosed beverage container holder will be or will become apparent to one with skill in the art upon examination of the following figures and detailed description. All such additional systems, devices, features, and advantages are intended to be included within this description, and are intended to be protected by the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION

Exemplary embodiments of the present beverage container holder are described below. The beverage container holder is configured to retain a beverage container in an upright position while holding the beverage container off of a ground surface, such that the beverage container is less likely to tip over and does not contact debris. The beverage container holder is optionally configured such that one holder can be nested within another holder so that the holders can be safely stored or transported while occupying less space.

Figure 1:
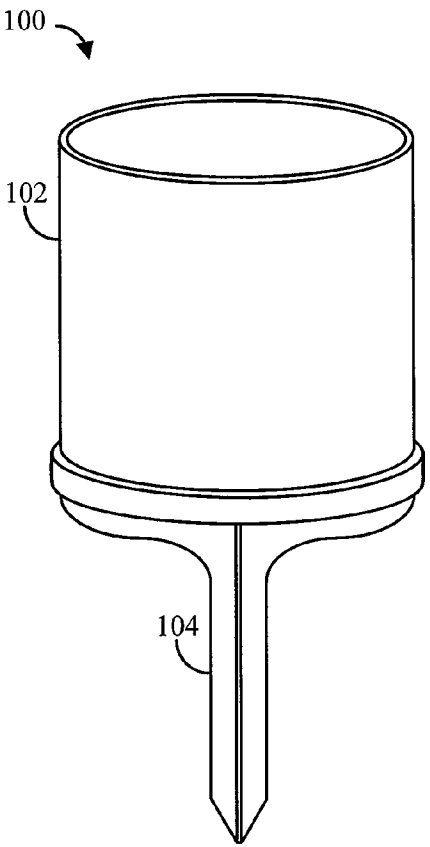
FIG. 1 is a side view of a first embodiment of an beverage container holder.

FIG. 1 is a side view of a first exemplary embodiment of the beverage container holder 100. The beverage container holder 100 includes a retaining member 102 and a stabilizing member 104. A beverage container (not shown) that is placed within the beverage container holder 100 is retained by the retaining member 102, such that the beverage container does not tip or contact debris.

Figure 2:
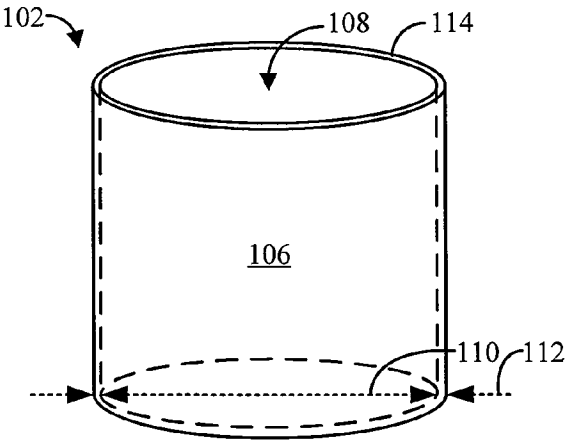
FIG. 2 is a side view of a retaining member of the embodiment of the beverage container holder shown in FIG. 1.

FIG. 2 is a side view of the retaining member 102 of the beverage container holder 100. The retaining member 102 is configured such that a beverage container (not shown) that is placed in the retaining member is surrounded and retained in an upright position. As shown, the retaining member 102 forms a cavity 106 having an opening 108, such that the beverage container can be placed into the cavity through the opening. An inner dimension 110 of the retaining member 102 may be at least the width of the beverage container which the beverage container holder 100 is intended to hold. An outer dimension 112 of the retaining member 102 is substantially the same as but slightly smaller than an inner dimension 122 of a flange 120 of the stabilizing member 104, as described below with reference to FIG. 3.

As shown, the retaining member 102 is a cylindrical sleeve or wall 114 having, for example, a height of about 3.5 inches and a thickness of about 0.1 inches. The inner dimension 110 of the sleeve 114 can be a diameter of about 3.25 inches and the outer dimension 112 of the sleeve is a diameter of about 3.45 inches. In embodiments not shown, the retaining member 102 may have other dimensions or may be other shapes, depending on the size and the shape of the beverage container with which the beverage container holder 100 is used. For example, the retaining member 102 may not be a sleeve 114. The sleeve also may not be cylindrical. For example, in embodiments in which the beverage container holder 100 is designed to be used with a juice box, the retaining member 102 may be square. Also, the sleeve may have any other dimensions. For example, the height of the retaining member 102 may be less than the height of the beverage container, such as a soda can, so that the user can easily retrieve the beverage container. Alternatively, the height of the retaining member 102 may be greater than the height of the beverage container such that the beverage container is substantially enclosed within the retaining member. Additionally, the retaining member may or may not have a bottom wall closing the bottom of the retaining member. Regardless of the size or shape of the retaining member 102, however, the retaining member has the opening 108, through which the beverage container can be placed into the cavity 106.

Figure 3:
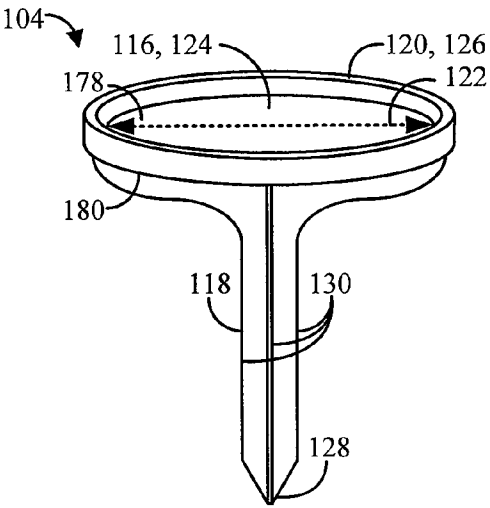
FIG. 3 is a side view of an stabilizing member of the embodiment of the beverage container holder shown in FIG. 1.

FIG. 3 is a side view of the stabilizing member 104 of the beverage container holder shown in FIG. 1. The stabilizing member 104 is configured to support the retaining member 102 along with any beverage container (not shown) that may be retained by it to reduce the possibility that the beverage container and/or the retaining member may be tipped over. Additionally, the stabilizing member can serve to support the retaining member apart from a ground surface into which the stabilizing member may be inserted. As shown, the stabilizing member 104 includes a base 116 and a surface penetrating member, such as a stake 118. The base 116 has a flange 120 that is coupled to an upper side 178 of the base and is shaped to mate with the retaining member 102, the inner dimension 122 of the flange 120 being substantially the same as but slightly larger than the outer dimension 112 of retaining member 102.

As shown, the base 116 is a circular plate 124, and the flange 120 is a cylindrical ring 126 around a periphery of the base 116. The inner dimension of the flange is a diameter of, for example, about 3.75 inches. In other embodiments, the base 116 and the flange 120 may have other dimensions and shapes, especially in cases in which the retaining member 102 is not a cylindrical sleeve 114.

The stake 118 is configured to penetrate the surface, for example sand on a beach, or grass turf or dirt, on which the beverage container would otherwise be placed, but for use of the present beverage container holder. Therefore, the stake 118 is coupled to a lower side 180 of the base 116 and includes a pointed tip 128 opposite the base. In the illustrated embodiment, the stake 118 has a cross-shaped cross-section having a series of four narrow projections 130 providing reinforcement for the stake. Each of the projections 130 extends from about the periphery of the base 116 to about a midpoint of the base, where the projection intersects and forms a right angle with the other projections. Each of the projections 130 also extends away from the base 116, tapering from the periphery of the base to form the pointed distal tip 128 with the other projections at the distal point from the base. Although the stake 118 is described above as including a series of four narrow projections 130, in other embodiments the stake may have other configurations that would be apparent to a person of skill. Furthermore, a plurality of stakes may be provided instead of one stake.

Figure 4:
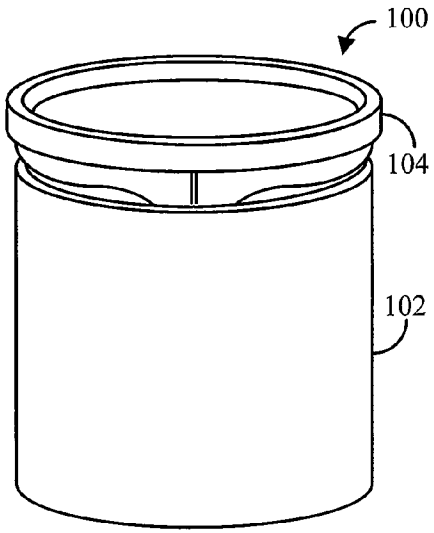
FIG. 4 is a side view of the embodiment of the beverage container holder shown in FIG. 1, illustrating the holder in a second position.

As shown in FIGS. 2-3, the retaining member 102 is separate from the stabilizing member 104, so that the beverage container holder 100 can be moved between a first position (shown in FIG. 1) and a second position (shown in FIG. 4). The first position may be a functional position, in which the beverage container holder 100 can function to retain a beverage container upright such that the beverage container does not tip while holding the beverage container off of a surface such that the beverage container does not contact debris on the surface, such as a ground surface. The first position may also be an assembled position, in which the parts of the beverage container holder 100 are assembled together. To achieve this position, the retaining member 102 of FIG. 2 is inserted into the stabilizing member 104 of FIG. 3. The retaining member 102 is coupled to the upper side 178 of the base 116 extending away from the base, with the flange 120 holding the retaining member in place, such as by friction or by a snap fitting. The stake 118 is coupled to the lower side 180 of the base 116 extending away from the base. As a result, the holder 100 is configured so that when the stake 118 is inserted into a surface such as the ground, the opening 108 is upright such that a beverage container can be retained in an upright position. In embodiments not shown, the retaining member 102 and the stabilizing member 104 may be a single piece. In such embodiments, the beverage container holder 100 is preformed into the first position shown in FIG. 1, with the flange 120 either present or omitted from the design.

FIG. 4 is a side view of the beverage container holder 100 in the second position. The second position may be an unassembled position, in which the beverage container holder 100 is not assembled. To change the beverage container holder 100 from the assembled position to the unassembled position, the retaining member 102 is separated from the stabilizing member 104. For example, the two pieces may be separated by pulling them apart. The pointed distal tip 128 of the stabilizing member 104 is inserted into the opening 108 of the retaining member 102 until the base 116 of the stabilizing member rests above the retaining member with the stake 118 hanging suspended in the cavity 106. The second position may also be a storage and/or transportation position, in which the beverage container holder 100 can be safely stored or transported. Such a position may be safer because the stake 118 of the stabilizing member 104 may be shielded by the retaining member 102. Such a position may also be conducive to storage and/or transportation, because the beverage container holder 100 may occupy relatively less space in the storage position than when in the functional position. The stabilizing member 104 can be designed to fit in this second position into the retaining member 102 by a friction fitting or a snap fitting, for example.

A modified second position is also possible. In this example, the position of the stabilizing member 104 in FIG. 4 can be reversed such that the stake 118 instead of being inserted into the opening 108 of the retaining member, extends outwardly of the opening 108. Where the retaining member 102 has a bottom wall completely closing the bottom portion of the retaining wall, reversing the position of the stabilizing member 104 in FIG. 4, would provide a complete enclosure for the beverage container which may be desirable when transporting a beverage container along with the beverage container holder providing, for example, insulation for the beverage container during transport. In a similar manner when, for example, spending time outdoors, one may wish to reverse the position of the retaining member as shown in FIG. 1 particularly where the retaining member has a completely closed bottom. In this manner, a beverage container may be held completely enclosed within the cavity 106 of the retaining member thereby preventing flies or sugar bees, or the like, from reaching the beverage container and also providing insulation from the heat when not drinking the beverage.

The retaining member 102 and the stabilizing member 104 can be formed from a variety of materials. For example, a non-conductive material can be used, such that the beverage container holder 100 does not tend to conduct heat toward or away from the beverage container, or an insulating material can be used such that the beverage container holder, for example, the retaining member 102, is configured to assist in maintaining the temperature of the beverage container. Alternatively, the retaining member 102 and, optionally the base 116, can have a double wall construction having an inner hollow space between the walls to provide an insulating effect for the beverage container. In some embodiments, the beverage container holder 100 may be formed from more than one material, with different materials being used for different elements of the holder. For example, the flange 120 of the base 116 may be formed from a relatively flexible material such as rubber, so that the flange can give as the retaining member 102 is inserted into the base 116 and can grip the retaining member 102 once it is in place. The base 116 may be formed from a relatively inflexible material such as plastic, enabling the base to properly support the retaining member 102 and any beverage container that is inserted into it. In cases in which the flange 120 and the base 116 are formed from different materials, the two pieces may be coupled together in any known manner, such as with adhesive. In some cases, the stake 118 may be formed from a material that is relatively strong and/or a material that is not brittle, such as a metal. Using such a material for the stake 118 may facilitate inserting the stake into a surface such as the ground.

The operation of the beverage container holder 100 will now be described, with reference to FIGS. 1-4. The beverage container holder 100 may be stored and transported in the second position shown in FIG. 4. Storing the beverage container holder 100 in the second position may be desirable because the holder occupies relatively less space in the second position than in the first position. Transporting the beverage container holder 100 in the second position may be desirable because the stake 118 of the holder is suspended within the cavity 106 of the retaining member 102, shielding the pointed distal tip 128. Once the beverage container holder 100 has been transported, the holder may be reconfigured from the second or unassembled position shown in FIG. 4 into the first or assembled position shown in FIG. 1. The retaining member 102 is inserted into the base 116 of the stabilizing member 104, for example, creating friction between the flange 120 and the retaining member 102 to hold the pieces together. The stake 118 is inserted into the surface, with the pointed distal tip 128 penetrating the surface and facilitating the passage of the stake into the surface so that the retaining member 102 is supported upright. A beverage container (not shown) that is inserted through the opening 108 into the cavity 106 is retained in the upright position without being exposed to debris on the surface and in a more stable position, less likely to tip over or be tipped over.

Figure 5:
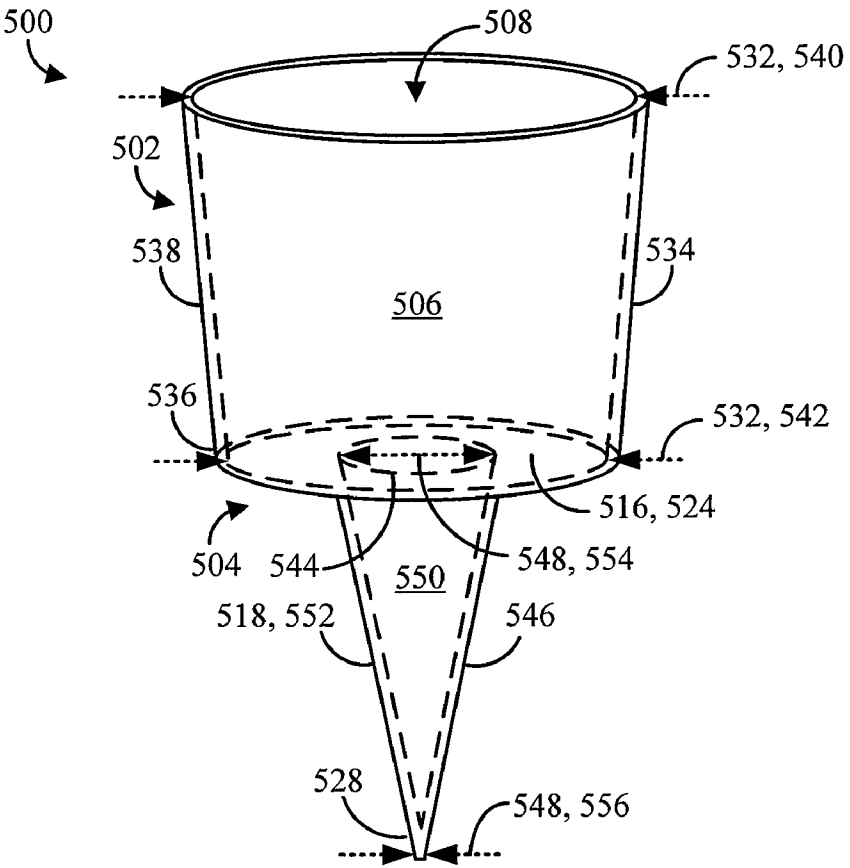
FIG. 5 is a side view of a second embodiment of a beverage container holder.

FIG. 5 is a side view of a second exemplary embodiment of a beverage container holder 500 of the present disclosure, which includes a retaining member 502 and a stabilizing member 504. Like the beverage container holder 100, the beverage container holder 500 can be moved between a first position (shown in FIG. 5) and a second position (shown in FIG. 6). The first position is a functional position, in which the beverage container holder 500 can function to retain a beverage container upright such that the beverage container does not tip while holding the beverage container apart from a surface such that the beverage container does not contact debris on the surface. Unlike the beverage container holder 100, the retaining member 502 and the stabilizing member 504 are not separate pieces. Instead, the beverage container holder 500 is pre-formed into a unitary piece, and cannot be moved between assembled and unassembled positions.

Figure 6:
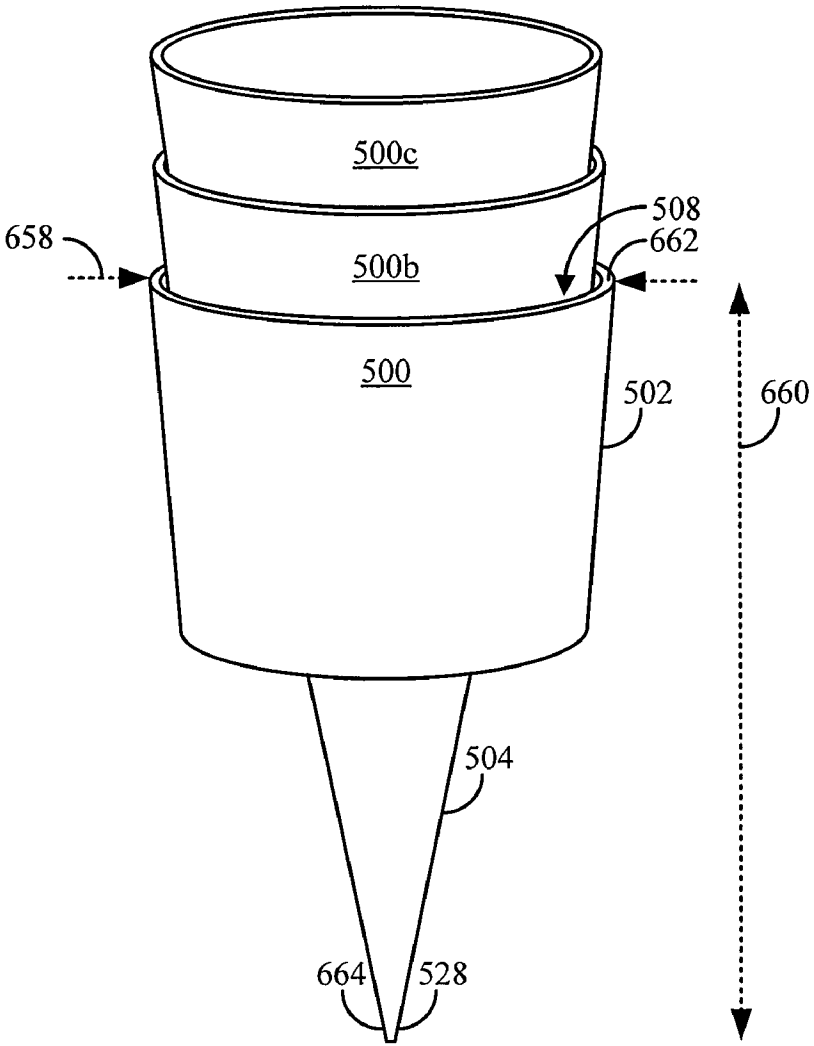
FIG. 6 is a side view of the embodiment of the beverage container holder shown in FIG. 5, illustrating the holder in a second position.

FIG. 6 is a side view of the beverage container holder 500 in a second position, in which the holder 500 mates with other similarly shaped holders, such as holders 500*b* and 500*c*. So that the beverage container holder 500 can be placed in the second position, both the retaining member 502 and the stabilizing member 504 are hollow and are tapered. A width 658 of the holder 500 continuously decreases along a height 660 of the holder, from an opening 508 at a top 662 of the holder 500 to a pointed distal tip 528 at a bottom 664 of the holder, with a step or shoulder in between. The second position may be a storage and/or transportation position, in which a plurality of beverage container holders 500 can be safely stored and/or transported. The pointed distal tip 528 of only one holder 500 is exposed, regardless of the number of holders being stored or transported, and as a group the plurality of holders 500 occupy relatively less space in the storage position than in the functional position. To assume the second position, the stake of the beverage container holder 500*b* is inserted into the opening 508 in the retaining member 502 of the holder 500, and the holder 500*b* is advanced through the holder 500 until it comes to rest inside the holder 500. A plurality of beverage container holders 500 can be inserted into each other in this manner. For example, the beverage container holder 500*c* can be inserted into and nested within the holder 500*b*.

With reference back to FIG. 5, the retaining member 502 forms a cavity 506 having the opening 508, such that a beverage container (not shown) can be placed into the cavity though the opening. A width 532 of the retaining member 502 may be at least the width of the beverage container with which the beverage container holder 500 is intended to be used. The width 532 is not uniform along the height of the retaining member 502, which instead has a taper 534 such that the width 532 continuously decreases from a maximum value at the opening 508 to a minimum value at an end 536 that is opposite from the opening 508.

As shown, the retaining member 502 is a tapered cylindrical sleeve 538. As an example, the width 532 can be a maximum diameter 540 of about 3.7 inches at the opening 508 and can be a minimum diameter 542 of about 3.25 inches at the end 536. The height of the retaining member 502 can be about 3.5 inches, and the taper 534 can be substantially linear such that the width 532 uniformly decreases.

The stabilizing member 504 includes a base 516 and a surface penetrating member such as stake 518. The base 516 is coupled to, and is sized and shaped to close, the end 536 of the retaining member 502. An opening 544 is formed in the base 516, and the stake 518 is coupled to the base adjacent the opening 544 and extending away from the base 516. Like the retaining member 502, the stake 518 has a hollow interior 550 and a taper 546 such that a width 548 of the stake continuously decreases from a maximum at the opening 544 to a minimum at the pointed distal tip 528.

In the illustrated embodiment, the base 516 is a circular plate 524 and the opening 544 is formed in the center of the circular plate. The stake 518 is a cone 552 having, for example, a height of about 3.5 inches, although other heights are possible. The taper 546 is substantially linear such that the width 548 uniformly decreases from a maximum diameter 554 at the opening 544 to a minimum diameter 556 at the pointed distal tip 528. For example, in the illustrated embodiment, the maximum diameter 554 is about 1.25 inches and the minimum diameter 556 is about 0.01 inches.

Although the beverage container holder 500 is described above as being a certain shape and having certain dimensions, the holder may have other configurations that would be apparent to a person of skill. In other embodiments, the size and shape of the retaining member 502 may vary depending on the size and the shape of the beverage container with which the beverage container holder 500 is used. For example, the retaining member 502 need not be a tapered cylindrical sleeve 538, the base 516 need not be a circular plate 524, and the stake 518 need not be a cone 552, or any of these parts may have dimensions other than the dimensions disclosed above. Additionally more than one stake 518 can be provided or other types of surface penetrating members can be provided. Regardless of the size or shape of the beverage container holder 500, however, the retaining member 502 has the opening 508 leading to the cavity 506, and the retaining member has the taper 534 such that the width 532 of the retaining member continuously decreases from the opening 508 to the end 536. The stake 518 also has the opening 544 leading to the hollow interior 550, and the stake has the taper 546 such that the width 548 of the stake continuously decreases from the opening 544 to the pointed distal tip 528. Because the beverage container holder 500 is hollow and has a width that continuously decreases along its height, the holder is configured to retain a beverage while in a first or function position (shown in FIG. 5) or to mate with other similarly shaped holders 500 in a second or storage position (shown in FIG. 6).

Figure 7:
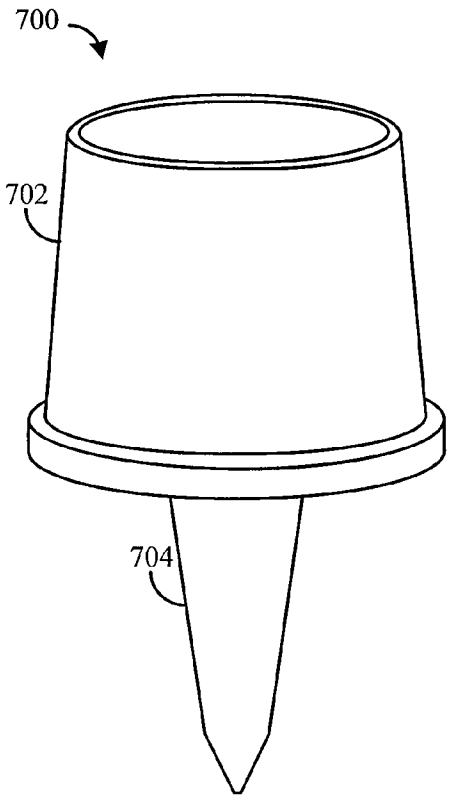
FIG. 7 is a side view of a third embodiment of a beverage container holder.

FIG. 7 is a side view of another exemplary embodiment of a beverage container holder 700 of the present disclosure. The beverage container holder 700 includes a retaining member 702 and a stabilizing member 704. Like the beverage container holder 100, the retaining member 702 and the stabilizing member 704 are separate pieces (shown in FIGS. 8-9) so that the beverage container holder 700 can be moved between a first or assembled position (shown in FIG. 7) and a second or unassembled (shown in FIG. 10). Like both the beverage container holders 100 and 500, the first position is a functional position, and the second position is a storage and/or transportation position, as described in greater detail below.

Figure 8:
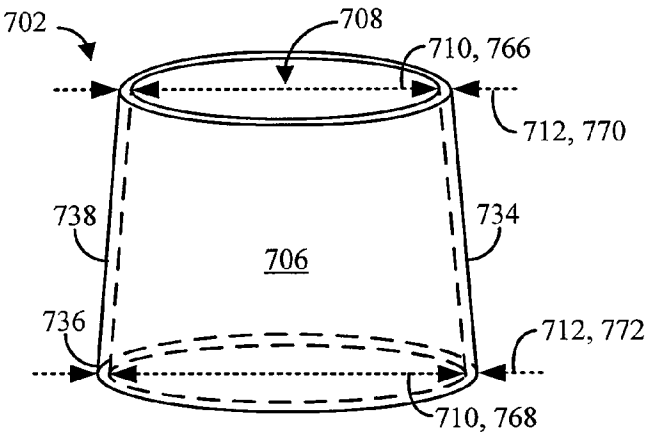
FIG. 8 is a side view of a retaining member of the embodiment of the beverage container holder shown in FIG. 7.

FIG. 8 is a side view of the retaining member 702 of the beverage container holder 700. The retaining member 702 forms a cavity 706 having an opening 708. An inner dimension 710 of the retaining member 702 is at least the width of the beverage container with which the beverage container holder 700 is intended to be used. An outer dimension 712 of the retaining member 702 is substantially the same as but slightly less than an inner dimension 722 of a flange 720 of the stabilizing member 704, as described below with reference to FIG. 9. The inner dimension 710 and the outer dimension 712 are not uniform along the height of the retaining member 702, which instead has a taper 734 such that each of the dimensions 710, 712 continuously increase from a minimum value at the opening 708 to a maximum value at an end 736 of the retaining member that is opposite from the opening.

As shown, the retaining member 702 is a tapered cylindrical sleeve 738. For example, the inner dimension 710 is a minimum inner diameter 766 of about 3.25 inches at the opening 708 and is a maximum inner diameter 768 of about 3.625 inches at the end 736. The outer dimension 712 is a minimum outer diameter 770 of about 3.375 inches at the opening 708 and is a maximum outer diameter 772 of about 3.75 inches at the end 736. The height of the retaining member 702 is about 3.5 inches, and the taper 734 is substantially linear such that the inner dimension 710 and the outer dimension 712 uniformly increase.

Figure 9:
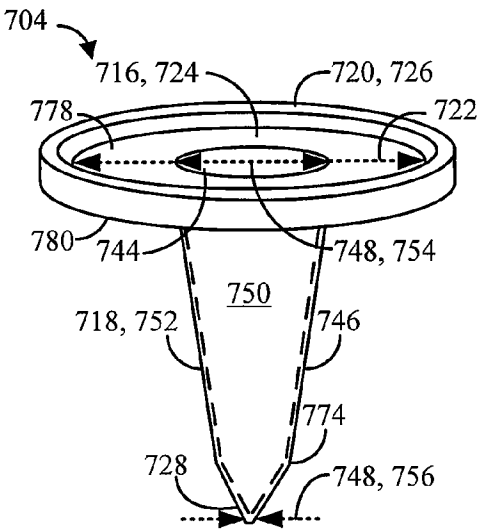
FIG. 9 is a side view of a stabilizing member of the embodiment of the beverage container holder shown in FIG. 7.

FIG. 9 is a side view of the stabilizing member 704 of the beverage container holder 700. The stabilizing member 704 includes a base 716 and a surface penetrating member such as stake 718. The base 716 has the flange 720 that is coupled to an upper side 778 of the base and is shaped to mate with the retaining member 702. The inner dimension 722 of the flange 720 is substantially the same as but slightly greater than the outer dimension 712 of retaining member 702 at the end 736. An opening 744 is formed in the base 716, and the stake 718 is coupled to a lower side 780 of the base adjacent the opening 744 and extending away from the base. The stake 718 has a hollow interior 750 and a taper 746 such that a width 748 of the stake continuously decreases from a maximum value at the opening 744 to a minimum value at the pointed distal tip 728. As illustrated the stake 718 has an edge 774 near the pointed distal tip 728, at which point the taper 746 abruptly accelerates inward, but in other embodiments the edge 774 may be omitted and the taper may be substantially linear from the opening 744 to the pointed distal tip.

As shown, the base 716 is a circular plate 724, and the flange 720 is a cylindrical ring 726 around a periphery of the base. For example, the inner dimension 722 of the flange 720 is about 3.75 inches, and the stake 718 is substantially a cone 752 having a height of about 3.0 inches. The taper 746 is substantially linear from the opening 744 to the edge 774 such that the width 748 uniformly decreases from a maximum diameter 754 at the opening to the diameter at the edge, where the taper accelerates inward. From the edge 774 to the pointed distal tip 728, the taper 746 is substantially linear such that the width 748 uniformly decreases from the diameter at the edge to a minimum diameter 756 at the pointed distal tip 728. For example, the maximum diameter 754 may be about 1.25 inches and the minimum diameter 756 may be about 0.01 inches.

Although the beverage container holder 700 is described above with reference to FIGS. 8-9 as being a certain shape and having certain dimensions, the holder may have other configurations that would be apparent to a person of skill. Regardless of the size or shape of the beverage container holder 700, however, the retaining member 702 has the opening 708 leading to the cavity 706, and the retaining member has the taper 734 such that the inner dimension 710 and the outer dimension 712 continuously increase from the opening 708 to the end 736. The stabilizing member 704 is separate from the retaining member 702, and the stake 718 has the opening 744, the hollow interior 750, and the taper 746 such that the width 748 of the stake continuously decreases from the opening 744 to the pointed distal tip 728. As a result, the retaining member 702 is configured to mate with other retaining members 702, and the stabilizing member 704 is configured to mate with other stabilizing members 704.

Figure 10:
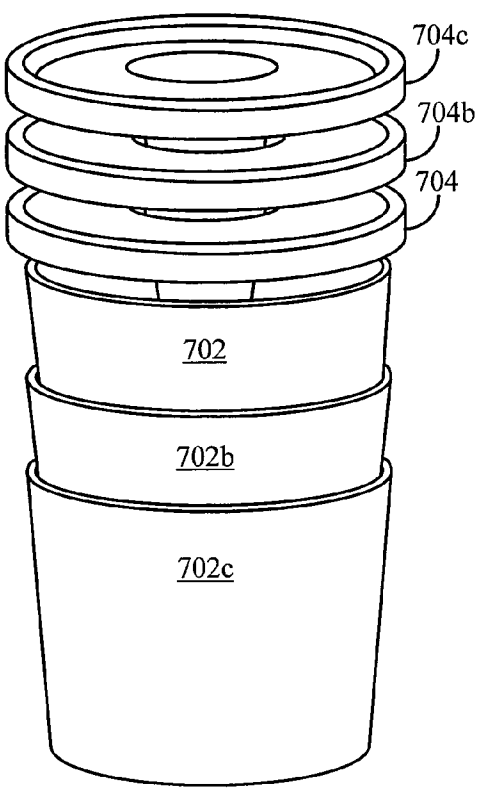
FIG. 10 is a side view of the embodiment of the beverage container holder shown in FIG. 7 in a second position, along with a plurality of other beverage container holders.

FIG. 10 is a side view of the beverage container holder 700 in the second position. As mentioned above, the second position is an unassembled position in which the retaining member 702 is separate from the stabilizing member 704. The second position is also a storage and/or transportation position, in which one or more beverage container holders 700 can be safely stored and/or transported. To assume the second position, the retaining member 702 is inverted and the pointed distal tip of the stabilizing member 704 is inserted into the end of the retaining member 702 until the base of the stabilizing member rests above the retaining member with the stake hanging suspended in the cavity. One or more additional retaining members (such as retaining members 702*b*, 702*c*) can mate with the retaining member 702 by stacking the retaining members on top of each other, and one or more additional stabilizing members (such as stabilizing members 704*b*, 704*c*) can mate with stabilizing member 704 by inserting the stabilizing members into each other. Such a position may be safer because the pointed distal tip of each stabilizing member 704, 704*b*, 704*c* is shielded either within the cavity of the retaining member 702 or within the stake of another stabilizing member. Such a position may also be conducive to storage and/or transportation, because the beverage container holders 700 occupy relatively less space in the storage position than when in the functional position, regardless of whether one holder 700 or a plurality of holders (such as holder 700, 700*b*, and 700*c*) are stored and/or transported.

Once the beverage container holder 700 has been transported, the holder may be reconfigured from the second or storage position shown in FIG. 10 to the first or functional position shown in FIG. 7. To achieve this position, the retaining member 702 of FIG. 8 is inserted into the stabilizing member 704 of FIG. 9, with the end 736 of the retaining member 702 being inserted adjacent the flange 720 of the base 716. The retaining member 702 is coupled to the upper side 778 of the base 716 extending away from the base, and is held in place due to, for example, friction or a snap fitting, between the flange 720 and the end 736 of the retaining member. The stake 718 is coupled to the lower side 780 of the base 716 extending away from the base. In such a functional position, the beverage container holder 700 can function to retain a beverage container upright while holding the beverage container apart from a surface, because the opening 708 and cavity 706 are upright and elevated when the stake 718 is inserted into a ground surface.

One skilled in the art would recognize that the beverage container holder 700 may have other configurations then illustrated in FIGS. 7-9. For example, the retaining member 702 may be reversed such that the taper of its side walls continually decreases from a maximum value at the opening 708 to a minimum value at an end 736, similar to the configuration of the retaining member 506 of FIG. 5. Similarly the retaining member 702 may have the shape of a hollow right cylinder like the retaining member 102 illustrated in FIG. 1. Likewise, the stabilizing member 704 can be provided with more than one stake 718.

To clearly illustrate the features of the beverage container holder, the holders 100, 500, and 700 are described separately above. However, a variety of embodiments would be apparent to a person of skill having features combined from more that one of the holders 100, 500, and 700. For example, the holder 700 could employ the stake described with reference to the holder 100, or the holder 500 could be formed from separate pieces like the holders 100 and 700 so that the holder 500 is movable between assembled and unassembled positions. The holder can also be provided with a cap or cover to fit over and close the opening or cavity in the retaining member 102, 502, 702, for example for enclosing a beverage container within its cavity. These are mere examples of combinations that would be apparent to a person of skill and are intended to be included within the scope of the present disclosure.

Additionally, the beverage container holder of the present disclosure can be made of any of a number of materials. Suitable materials include, for example, a hard moldable plastic such as polypropylene and polyvinyl chloride, metal materials such as stainless steel, and even wood. The beverage container holder can be made so that it does or does not provide insulation for a beverage container. If insulation is desired, for example, the walls of the retaining member 102, 502, 702 can have a double wall configuration including an air space in between the walls, as well as the base portion of the stabilizing member 104, 504, and 704. Alternatively, the retaining member 102, 502, 702 can be made of a material, such as, but not limited to, the foam material used in can huggers and bottle huggers, to provide insulation for the beverage container.

In addition to providing a holder for a beverage container, the beverage container holder of the present disclosure can also be used and sold as a novelty or corporate give away item. The holder can be provided with the name of an individual or a company name or a logo for this purpose.

While particular embodiments of an beverage container holder have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

The invention claimed is:

1. A beverage container holder comprising:

a retaining member having an opening therein configured to retain a beverage container in an upright position; and a stabilizing member configured for insertion into a surface and for supporting the retaining member in a generally upright position, the stabilizing member including a base configured to support the beverage container, the base having an upper side configured to be releasably secured to an end of the retaining member opposite from the opening in the retaining member, the stabilizing member having a member configured for penetrating the surface, the member being coupled to a lower side of the base, wherein the retaining member is separate from the stabilizing member and has a cavity formed therein that is in communication with the opening therein; and the beverage container holder is movable between a first position in which the end of the retaining member opposite the opening therein is coupled to the upper side of the base, and a second position in which the penetrating member of the stabilizing member is inserted into the opening of the retaining member and the base of the stabilizing member is releaseably secured over the opening in the retaining member with the penetrating member coupled to the lower side of the base stored within the cavity of the retaining member.

2. The beverage container holder of claim 1, wherein the retaining member is a sleeve forming the cavity in communication with the opening, such that a beverage container can be placed into the cavity through the opening.

3. The beverage container holder of claim 1, wherein the base has an opening formed substantially in a center of the base, and the member coupled to the lower side of the base is a stake is coupled to the lower side of the base adjacent the opening.

4. The beverage container holder of claim 3, wherein the stake is hollow and tapers inward from the opening to the distal tip, such that the stake can mate with the stake of another such beverage container holder.

5. The beverage container holder of claim 1, wherein the retaining member is tapered and can be removed from the base and nested at least partially within another retaining member of another such beverage container.

6. The beverage container holder of claim 1, wherein the stabilizing member supports the retaining member apart from the surface.

7. A beverage container holder comprising:

a beverage container a retaining member having a to opening therein configured to receive and retain the beverage container in an upright position and a base having a bottom opening; and a stabilizing member configured for insertion into a surface and for supporting the retaining member in a generally upright position, the stabilizing member including a base configured to support the beverage container, the base having an upper side configured to be releasably secured to the base of the retaining member opposite from the top opening in the retaining member, the stabilizing member having a member configured for penetrating the surface, the member being coupled to a lower side of the base, the base of the stabilizing member having a flange coupled to the upper side of the base about a periphery of the base for releasably securing the retaining member to the stabilizing member, wherein:

the retaining member includes a sleeve;

an inner dimension of the to opening of the sleeve is sized to be at least the width of the beverage container;

the retaining member having a reverse taper such that the sleeve of the retaining member has an outer dimension that substantially uniformly increases from the top opening to the bottom opening allowing for one retaining member to be nestable within another retaining member; and an outer dimension of the base of the sleeve is substantially the same as but is slightly smaller than an inner dimension of the flange, such that the base of the retaining member contacts the flange and is held in place by friction.

8. A beverage container holder comprising:

a retaining member having an opening therein configured to retain a beverage container in an upright position; and a stabilizing member configured for insertion into a surface and for supporting the retaining member in a generally upright position, the stabilizing member including a base configured to support the beverage container, the base having an upper side configured to be releasably secured to an end of the retaining member opposite from the opening in the retaining member, the stabilizing member having a member configured for penetrating the surface, the member being coupled to a lower side of the base, wherein the base has a flange coupled to the upper side of the base about a periphery of the base for releasably securing the retaining member to the stabilizing member, wherein:

the retaining member is a tapered cylindrical sleeve;

an inner dimension of the sleeve is at least the width of a beverage container to be retained therein; and an outer dimension of the sleeve substantially uniformly increases from a minimum value at one end of the sleeve to a maximum value at an opposite end of the sleeve, one of the ends of the sleeve having an outer dimension being substantially the same as but slightly smaller than an inner dimension of the flange coupled to the upper side of the base.

9. A beverage container holder comprising:

a retaining member having an opening therein configured to retain a beverage container in an upright position; and a stabilizing member configured for insertion into a surface and for supporting the retaining member in a generally upright position, the stabilizing member including a base configured to support the beverage container, the base having an upper side configured to be releasably secured to an end of the retaining member opposite from the opening in the retaining member, the stabilizing member having a member configured for penetrating the surface, the member being coupled to a lower side of the base, wherein:

the retaining member is separate from the stabilizing member and has a cavity formed therein; and the beverage container holder is movable between a first position in which the retaining member is coupled to the upper side of the base, and a second position in which the retaining member is not coupled to the base, such that the retaining member can be stacked on top of another retaining member of another such beverage container holder, the stabilizing member can be inserted into the retaining member with the penetrating member coupled to the lower side of the base stored within the cavity, and another stabilizing member of another such beverage container holder can be inserted into the upper side of the stabilizing member.

10. A beverage container holder comprising:

a retaining member configured to retain a beverage container in an upright position, the retaining member having an opening in a top of the holder and having a cavity therein in communication with the opening that is configured to receive the beverage container; and a stabilizing member coupled to the retaining member, the stabilizing member configured to support the retaining member apart from a surface, the stabilizing member having at least one pointed distal tip at a bottom of the holder configured to penetrate the surface, the beverage container holder being hollow and tapered such that a width of the holder continuously decreases along a height of the holder from the opening in the retaining member to the pointed distal tip of the stabilizing member, wherein the retaining member is a tapered cylindrical sleeve having a diameter that substantially uniformly decreases from a maximum value at the opening to a minimum value at an end coupled to the stabilizing member and wherein the stabilizing member includes a circular plate and a hollow, tapered cone coupled to the plate adjacent an opening in the plate, the cone having a width that substantially uniformly decreases from the opening in the plate to the pointed distal tip, allowing a second such beverage container holder to be nested within said beverage container holder.

* * * * *